US005231333A

United States Patent [19]

Orenstein

[11] Patent Number: 5,231,333

[45] Date of Patent: Jul. 27, 1993

[54] SWITCHING EXCITATION SUPPLY FOR GAS DISCHARGE TUBES HAVING MEANS FOR ELIMINATING THE BUBBLE EFFECT

[75] Inventor: Edward D. Orenstein, Edina, Minn.

[73] Assignee: Neon Dynamics, Inc., Minnetonka, Minn.

[21] Appl. No.: 613,245

[22] Filed: Nov. 14, 1990

[51] Int. Cl.[5] ..... H05B 41/36

[52] U.S. Cl. ..... 315/219; 315/209 R; 315/223; 315/225; 315/DIG. 7; 315/176

[58] Field of Search ..... 315/209 R, 219, 225, 315/127, 223, 224, DIG. 7, 176, 170, 172, 174

[56] References Cited

U.S. PATENT DOCUMENTS

| | | | |
|---|---|---|---|
| 3,789,266 | 1/1974 | Polman et al. | 315/194 |
| 3,833,761 | 9/1974 | Houck | 178/7.1 |
| 3,968,400 | 7/1976 | Weinverch | 315/176 X |
| 4,327,309 | 4/1982 | Wallot | 315/170 |
| 4,337,418 | 6/1982 | Walz | 315/362 |
| 4,362,971 | 12/1982 | Sloan. Jr. | 315/176 |
| 4,373,146 | 2/1983 | Bonazoli et al. | 315/209 R |
| 4,438,374 | 3/1984 | Karius | 315/362 |
| 4,463,286 | 7/1984 | Justice | 315/219 |
| 4,492,899 | 1/1985 | Martin | 315/219 X |
| 4,547,705 | 10/1985 | Hirayama et al. | 315/219 |
| 4,667,132 | 5/1987 | Leale | 315/282 |
| 4,682,082 | 7/1987 | Macaskill et al. | 315/219 |
| 4,719,390 | 1/1988 | Sairanen | 315/206 |
| 4,733,135 | 3/1988 | Haulet | 315/224 |
| 4,803,406 | 2/1989 | Yasuda et al. | 315/174 |
| 4,862,039 | 8/1989 | Kile et al. | 315/224 X |
| 4,862,042 | 8/1989 | Herrick | 315/281 X |
| 4,870,326 | 9/1989 | Anderson et al. | 315/200 R |
| 4,891,561 | 1/1990 | Amano et al. | 315/223 |
| 4,914,356 | 4/1990 | Cockran | 315/307 |
| 4,916,362 | 4/1990 | Orenstein | 315/219 |
| 4,980,611 | 12/1990 | Orenstern | 315/225 |
| 5,001,386 | 3/1991 | Sullivan et al. | 315/219 |
| 5,034,660 | 7/1991 | Sairanen | 315/17 X |
| 5,055,747 | 10/1991 | Johns | 315/224 X |
| 5,103,138 | 4/1992 | Oreustem et al. | 315/209 R |

FOREIGN PATENT DOCUMENTS

| | | |
|---|---|---|
| 10336642 | 10/1989 | European Pat. Off. . |
| 2120870 | 12/1983 | United Kingdom . |

*Primary Examiner*—Joseph E. Clawson, Jr.
*Assistant Examiner*—Do Hyun Yoo
*Attorney, Agent, or Firm*—Merchant, Gould, Smith, Edell, Welter & Schmidt

[57] ABSTRACT

The present invention describes a method and apparatus for a high frequency switching gas discharge tube supply which suppresses or eliminates the "bubble effect" in gas discharge tubes containing neon or argon-mercury gas or other gases and which eliminates the migration of mercury or other migratory gases toward one electrode over time. To prevent mercury migration to one electrode over time within an argon-mercury gas discharge tube, a line frequency bias voltage is induced on the high frequency, high excitation voltage resulting in a gas discharge tube display which is uniform in intensity of light over the length of the tube.

2 Claims, 3 Drawing Sheets

SWITCHING EXCITATION SUPPLY FOR GAS DISCHARGE TUBES HAVING MEANS FOR ELIMINATING THE BUBBLE EFFECT

FIELD OF THE INVENTION

The present invention applies to the field of excitation of gas discharge tubes and more particularly to switching power supplies used for exciting neon, argon-mercury, and the like, gas discharge tubes and to methods and apparatus for preventing the "bubble effect" in such tubes.

BACKGROUND OF THE INVENTION

The most popular gas discharge tubes in use for displays are the types which use neon gas or a combination of argon and mercury gases. The neon gas when excited glows at a characteristic red color. The combination of argon and mercury gases when excited typically glow in a pale blue color. All other colors used in display signs are typically phosphor-coated tubes in which argon and mercury gases are placed. The argon-mercury vapors are excited which in turn cause the phosphors to glow. The phosphors then glow at the selected color.

Excitation power supplies for gas discharge tubes and in particular for neon or argon-mercury discharge tubes, have been known for many years. The most common form of a discharge supply is a neon light transformer having a 60 Hz, 120 volt AC primary with 60 Hz approximately 10 KVAC secondary which is directly connected to the electrodes attached to either end of the gas discharge tube. A transformer of this size tends to weigh 10–20 pounds due to the massive core, the number of primary and secondary windings and the potting of the transformer in a tar-like material to prevent arcing. This results in a very large, bulky and unsightly excitation supply.

More recently, light-weight switching power supplies have been used to step up the 60 Hz, 120 VAC voltage to a higher frequency for exciting gas discharge tubes. In general, the higher switching frequency allows the use of smaller, more light-weight transformers. The switching frequency may be fixed or may be variable as described in U.S. Pat. No. 4,916,362 entitled "Excitation Supply for Gas Discharge Tubes" issued Apr. 10, 1990 and assigned to the same assignee of the present invention, which is hereby incorporated by reference.

A high frequency excitation supply attached to a gas discharge tube may cause a "bubble effect". This effect varies according to the length and volume of the gas discharge tube, the gas pressure, the temperature and type of gas used in the tube, and other factors. The bubble effect is caused by a standing wave appearing at a high frequency within the discharge tube resulting in alternate areas of light and dark in the tube. The standing wave may not be exactly matched to the length of the tube resulting in a scrolling or crawling bubble effect in which the bubbles slowly move toward one end of the tube. This may be a desirable effect in some gas discharge tube displays but, in general, it is undesirable for display tubes. The problem of the bubble effect is that its appearance is unpredictable because of the number of variables which may cause the bubble effect.

One solution to the bubble effect is to place a DC bias across the tube on top of the high-frequency excitation voltage. The DC bias helps eliminate the bubble effect in most gas discharge tubes, but creates another undesirable effect in argon-mercury gas discharge tubes. A DC bias in an argon-mercury gas discharge tubes causes a slow migration of the mercury to one electrode over time. This disproportionate distribution of mercury results in a dimming of the tube at one end. Hence the DC bias approach for eliminating the bubble effect in argon-mercury tubes may be unacceptable.

There is a need in the prior art, therefore, for a single high frequency switching gas discharge tube supply which may be used for either argon-mercury gas discharge tubes or neon gas discharge tubes. Such a supply should effectively suppress or eliminates the "bubble effect" in these types of gas discharge tubes without causing the migration of mercury toward one electrode over time in an argon-mercury gas discharge tube.

SUMMARY OF THE INVENTION

To overcome the shortcomings of the prior art described above, and to overcome other shortcomings of the prior art that will be understood by one skilled in the art upon reading and understanding the present specification, the present invention use a high frequency switching power supply to produce a high excitation voltage and places a 60 Hz bias on the high voltage output to prevent the bubble effect in gas discharge tubes. To prevent mercury migration to one electrode over time within an argon-mercury gas discharge tube, the 60 Hz bias has the same relative effect as a DC bias which is periodically reversed in direction without the attendant cost in implementation and failure potential. This results a gas discharge tube display which is uniform in intensity of light over the length of the tube.

BRIEF DESCRIPTION OF THE DRAWINGS

In the drawings, where like numerals describe like components throughout the several views.

DETAILED DESCRIPTION OF THE PREFERRED EMBODIMENT

In the following detailed description of the preferred embodiments, reference is made to the accompanying drawings which form a part hereof, and in which is shown by way illustration specific embodiments in which the invention may be practiced. These embodiments are described in sufficient detail to enable those skilled in the art to make and practice the invention, and it is to be understood that other embodiments may be utilized and that structural, electrical or logical changes may be made without departing from the scope of the present invention. The following detailed description is, therefore, not to be taken in a limiting sense, and the scope of the present invention is defined only by the appended claims.

Figure 1:
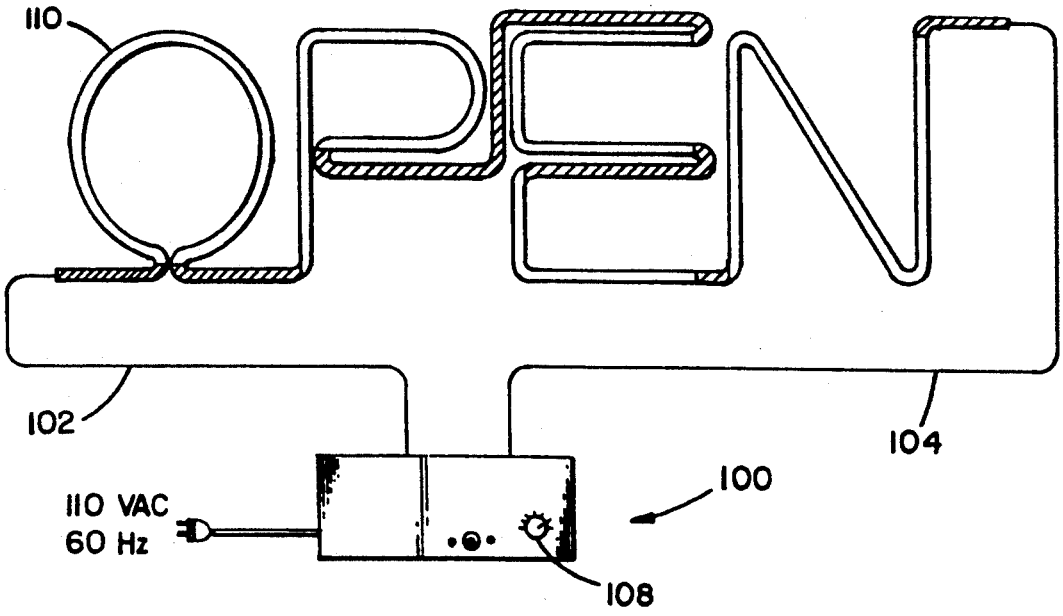
FIG. 1 shows an application of the present invention for driving a gas discharge tube sign.

FIG. 1 shows the application of the present invention to a gas discharge tube 110 which in this application is in a shape of a sign spelling the word OPEN. The gas discharge tube 110 may contain neon, argon-mercury or some other combination of excitable gases. The tube 110 may be internally coated with a phosphor to give it different colors and includes shaded portions of the tube which are painted with an opaque material to prevent the light from the glowing gas or phosphor from shining through. In this fashion, a single length of tube may be used to fashion the word OPEN without segmentation.

This application of gas discharge tubes bent in the shape of words or figures or other artistic shapes is well known in the art. The tube may be of any length and may vary the gas pressure according to the application. The gas discharge tube is connected by means of electrodes 102 and 104 to opposite ends of discharge tube 110. Electrodes 102 and 104 receive high voltage from switching power supply 100. The electrodes 102 and 104 must necessarily be well insulated wires to prevent arcing or otherwise electrocution to the user. Power supply 100 receives its operating voltage from the AC mains which, in the U.S., is a line voltage of 110 VAC at 60 Hz.

The excitation supply 100 is shown with a variable frequency knob 108 which is used to vary the primary frequency of the supply, as described in more detail below. Those skilled in the art will readily recognized that a fixed frequency supply 100 may be substituted, therefore, in which the high frequency switching signal is fixed at the factory. Knob 108 shown in FIG. 1 is used to set the operating frequency and, hence, the output voltage of the supply to obtain the best brightness or output impedance match between the supply 100 and the gas discharge tube 110. The optimal brightness or desired brightness once obtained may include a bubble effect created in the discharge tube 110. Varying the frequency 108 of the supply 100 may eliminate the bubble effect but the optimal or desired brightness may be destroyed. A variable frequency power supply for driving gas discharge tubes is shown in U.S. Pat. No. 4,916,362 entitled "Excitation Supply for Gas Discharge Tubes" issued Apr. 10, 1990 and assigned to the same assignee of the present invention, which is hereby incorporated by reference.

The application of a slight DC bias by supply 100 placing electrode 102 at a slightly higher or lower DC voltage than electrode 104 eliminates the bubble effect. As will be described in more detail below, the required DC bias may be minimally a few hundred volts. The DC bias may effectively eliminate the bubble effect in neon and argon-mercury gas discharge tubes.

An undesirable effect may result from placing a DC bias between electrodes 102 and 104 when using an argon-mercury gas within tube 110. The DC bias tends to move the mercury vapor within the tube over time such that the mercury migrates to one electrode of the tube. This tends to cause dimming at one end of the tube over the long term. Depending upon the makeup of the tube such as the gas pressure, the length of the tube, the voltage of the supply, the operating frequency and the like, this migration may take days, weeks or even months to appear.

One solution to eliminating the migration is to occasionally reverse the DC bias on electrodes 102 and 104 using a DC bias reversal means so that over the long term the migration of the mercury to one end of the tube is eliminated. An example of this solution is found in U.S. Pat. application No. 07/515,165 entitled "Switching Excitation Supply for Gas Discharge Tubes Having Means for Eliminating the Bubble Effect", filed Apr. 26, 1990, which is assigned to the same assignee of the present invention and is hereby incorporated by reference. This solution, while effective, may not be cost-effective in some situations and the components used to switch the DC bias may have an unacceptable failure rate in some applications. The present invention places a 60 Hz line frequency bias on the output voltage to reduce or eliminate the bubble effect without causing mercury migration, as is more fully described below.

Figure 2:
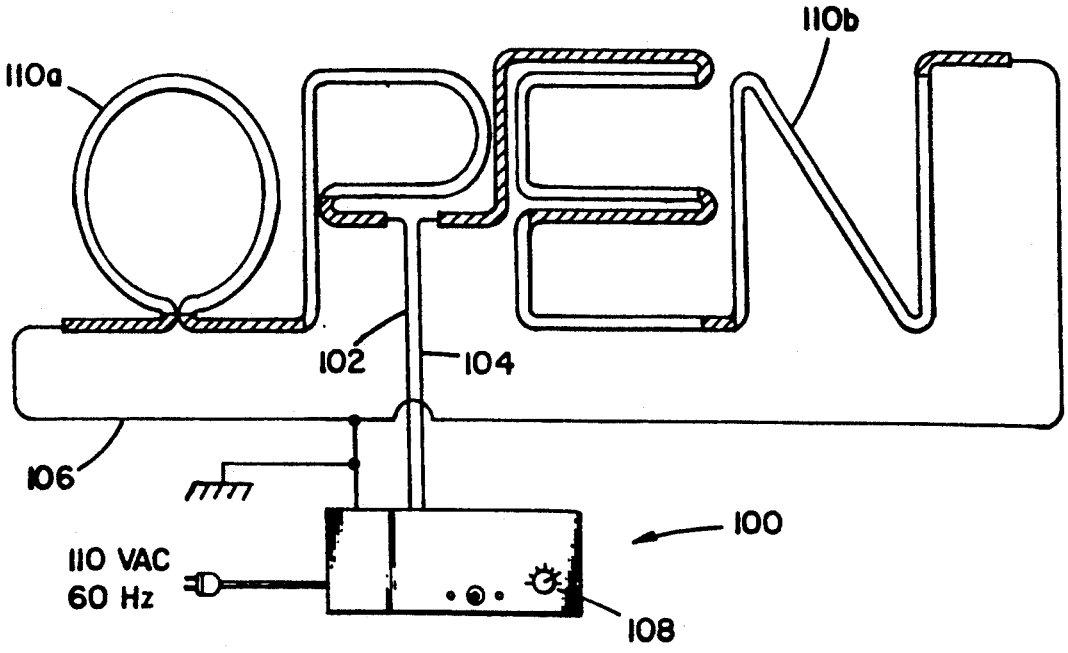
FIG. 2 is another application of the present invention driving a gas discharge tube sign.

FIG. 2 shows an alternate connection of power supply 100 to gas discharge tube 110. The application of the supply shown in FIG. 2 is advantageous to connecting high voltage switching power supplies to very long tube runs. For example, the tube 110 could be segmented into sections 110(*a*) and 110(*b*). Each section in a very large sign could be, for example, 25 feet in overall tube length. If implemented using the technique shown in FIG. 1, very long runs of high voltage cable 102, 104 would be required. The impedance of such a long run may be prohibitive as well the cost and required shielding for such a long run. In the implementation shown in FIG. 2, the high voltage electrodes 102 and 104 each contact one local electrode of segment 110(*a*) and 110(*b*) respectively while the ends of segments 110(*a*) and 110(*b*) are connected via low voltage wire 106 to the chassis or ground of supply 100. In this implementation, and as will be described in conjunction with FIG. 4, electrodes 102 and 104 are taken from end taps of transformer T1 while low voltage or common electrode 106 is taken from the grounded center tap of high voltage output transformer T1. In this fashion, by placing the power supply close to the center of sign 110, high voltage leads and shielding for wires 102 and 104 need only be short by the ends of the run through line 106 may use conventional wire and conventional shielding or conduit.

Figure 3:
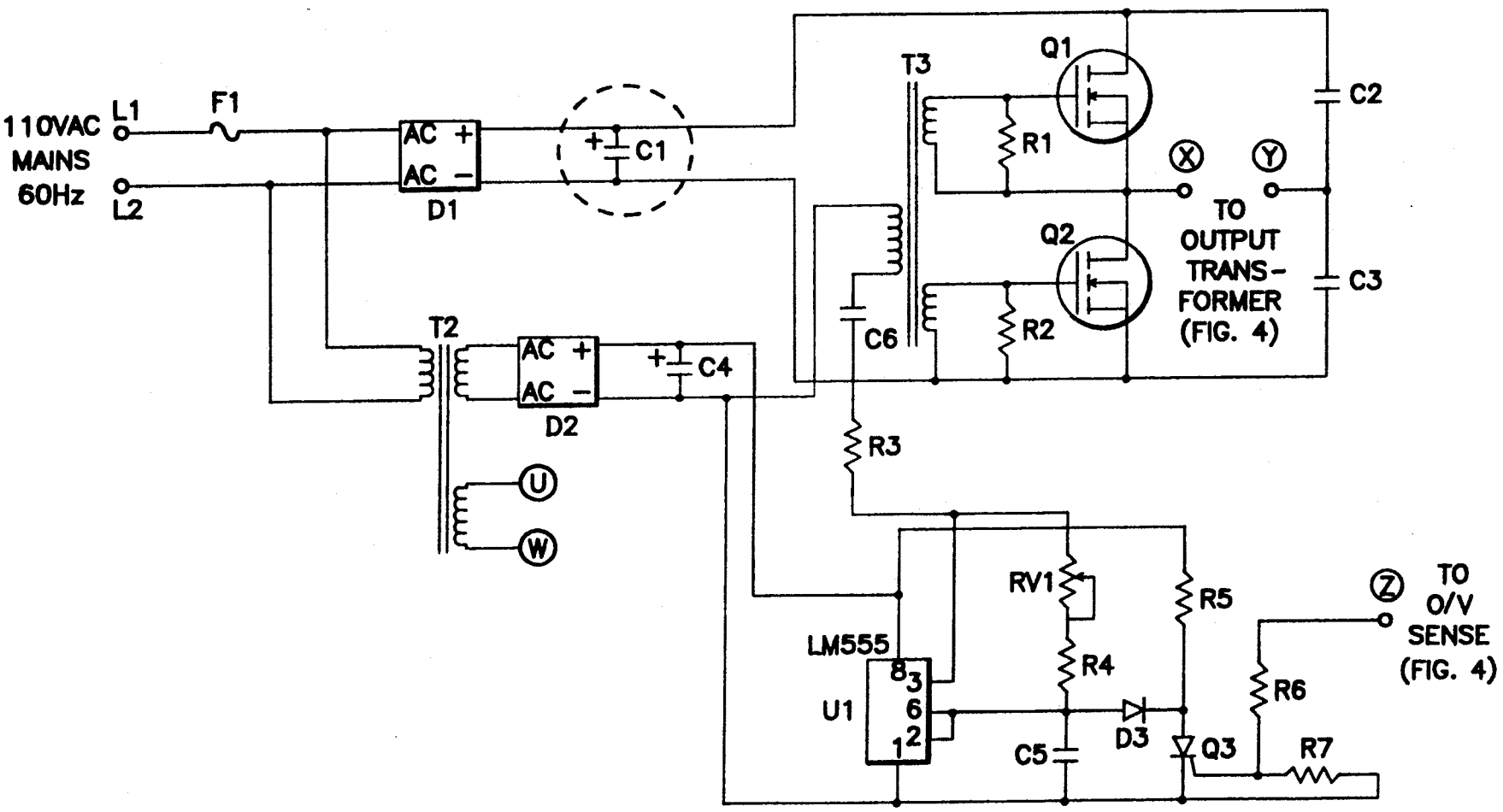
FIG. 3 is a detailed electrical schematic diagram of a high frequency switching power supply for driving a gas discharge tube.
Figure 5:
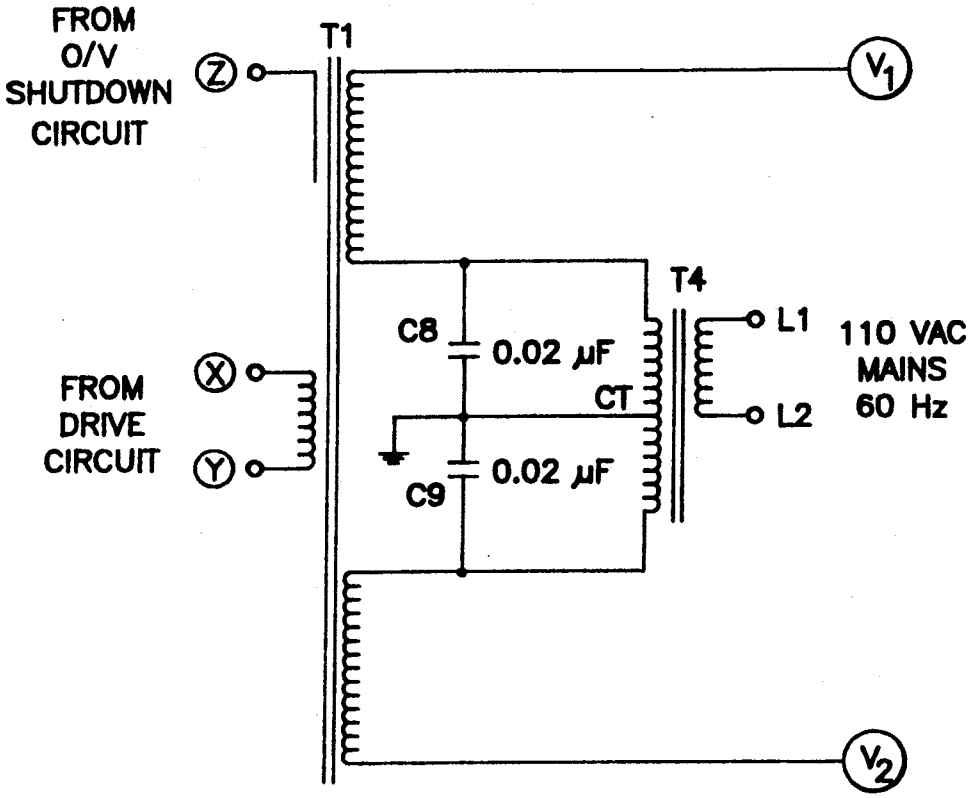
FIG. 5 is a detailed electrical schematic diagram showing a second embodiment of the present invention for placing a line frequency bias on the high voltage output of the high frequency switching power supply for gas discharge tubes.
Figure 4:
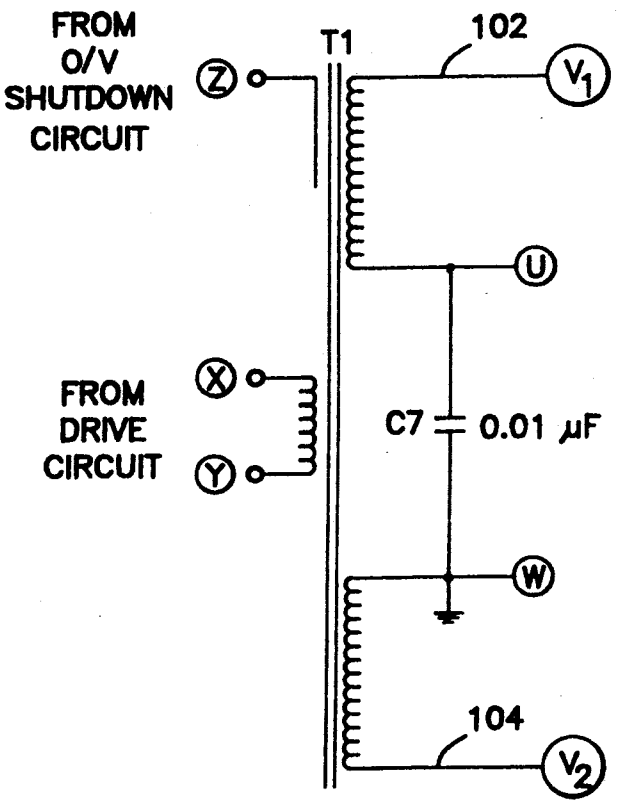
FIG. 4 is a detailed electrical schematic diagram showing one embodiment of the present invention for placing a line frequency bias on the high voltage output of the high frequency switching power supply for gas discharge tubes.

Referring to FIGS. 3, 4 and 5, the detailed electrical operation of the preferred embodiments of the present invention will be described. The 110 VAC, 60 Hz mains supply is provided on lines L1 and L2 shown in the upper left of FIG. 3. The primary operating current is rectified through a bridge rectifier D1. The resultant direct current is filtered by bulk capacitor C1 which is in the preferred embodiment 220 microfarads. The direct rectified line voltage off AC mains is typically 160 volts DC peak across capacitor C1.

The DC supply voltage is stored in capacitor C1 and continuously supplied from the AC mains and is supplied to the primary of main power transformer T1 (shown in FIG. 4) through capacitors C2 and C3 and transistors Q1 and Q2. Capacitors C2 and C3 along with the input inductance seen by the primary on power transformer T1 form a resonant convertor circuit which switches the DC power through the secondary of step up power transformer T1. A high output voltage is produced across the dual secondaries of transformer T1. Since a high frequency signal is switched into the secondaries of transformer T1, the capacitor C7 linking the secondaries is seen as a dead short to the high frequency signal and a high voltage is produced across the entire secondary of T1. The resultant switched current is applied through the output terminals $V_1$ and $V_2$ to the discharge tube for exciting the gas therein. Terminals $V_1$ and $V_2$ would be connected to tube 110 shown in FIG. 1 through wires 102 and 104 respectively.

As is well understood by those skilled in the art, the impedance of the gas discharge tube attached to terminals $V_1$ and $V_2$ will effect the impedance seen at the primary of transformer T1 and thus, will effect the optimal power transfer point based on the switching frequency of the resonant convertor. Thus, depending on the impedance attached to terminals $V_1$ and $V_2$, the optimal switching frequency must be selected to effect the best possible power transformer. By varying the switching frequency between approximately 18–50 kHz (keeping the frequency above audio range), the output voltage on terminals $V_1$ and $V_2$ may be varied between approximately 4 KV–15 KV depending on the impedance of the gas discharge tube attached between $V_1$–$V_2$.

The voltage switched through the resonant convertor constructed as a part of capacitors C2 and C3 and power transformer T1 is switched through power MOSFETS Q1 and Q2. These transistors are, in the preferred embodiment, part number IRF620 available from International Rectifier and other vendors. Capacitor C2 and C3 are, in the preferred embodiment, one microfarad 250 volt capacitors. The gates of MOSFETs Q1 and Q2 are controlled such that neither MOSFET is ON at the same time. The alternating switching of the gates of transistors Q1 and Q2 vary the direction of the current through the primary of power transformer T1. The alternate switching of Q1 and Q2 cause a resonant current to develop in the primary of transformer T1 which is in turn transferred to the secondary of transformer T1 and on to the gas discharge tube 110. Control of the power MOSFETs Q1 and Q2 is effected by the switching control circuit shown in the lower half of FIG. 3.

In the preferred embodiment of the present invention, the main controller for establishing the variable switching frequency is by means of a monolithic timer circuit, Part No. LM555 available from National Semiconductor and a wide variety of other vendors. This timer circuit U1 also is an integral part of the overvoltage shutdown circuit also shown to the lower half of FIG. 3.

The supply voltage for driving the 555 timer U1 is by means of DC supply circuit connected to the AC mains. The control supply transformer T2 is attached across lines $L_1$ and $L_2$ of the AC mains and serves to step down the AC mains voltage to approximately 20 volts AC which is applied to a full wave rectifier bridge D2. The resultant rectified pulse DC voltage is filtered by capacitor C4 which is, in the preferred embodiment, a 47 microfarad, 50 volt electrolytic capacitor. The resultant 20 volt DC low voltage supply is applied between pins 8 and 1 of 555 timer circuit U1.

The 555 timing circuit U1 is operable in oscillator mode in which the frequency and duty cycle are both controlled with external resistors and capacitors. By applying a trigger signal to the trigger input on pin 2 also applied to the threshold input on pin 6, the timing cycle is started and an internal flip-flop is set, immunizing the circuit from any further trigger signals. The frequency of operation or the timing interval is determined by the combination of resistor RV1 and R4 with capacitor C5 forming a RC timing circuit. In the preferred embodiment, variable resistor RV1 is a 5K, 10 turn potentiometer while resistor R4 is approximately 4K ohms. Timing capacitor C5 is approximately 0.0047 microfarads. As taught by the manufacturer, the resultant frequency of operation of the 555 timer U1 is $$f = \frac{1.44}{(RV1 + 2R4)C5}.$$

The output of 555 timer U1 on pin 3 is applied to pulse transformer T3 to create the timing pulses to drive the gates of transistors Q1 and Q2. Those skilled in the art will readily recognize that a wide variety of timing circuits may be substituted for the type described here. For example, monostable multivibrator circuits, discrete RC timing circuits, micro-controller or microprocessor circuits and other control circuits may be substituted for driving switching transistors Q1 and Q2 without departing from the spirit and scope of the present invention. The use and selection shown in FIG. 3 is but one of a variety of preferred implementations.

The output from pin 3 of 555 timer circuit U1 drives pulse transformer T3 through resistor R3 and capacitor C6. Resistor R3 is, in the preferred embodiment, approximately 22 ohms dissipating at least one-half watt of power while capacitor C6, is, in the preferred embodiment, approximately 1.0 microfarads with a 250 volt breakdown voltage. The secondary outputs of pulse transformer T3 drive the bases of transistors Q1 and Q2. The direction of the windings of the secondaries on pulse transformer T3 are arranged such that a positive going pulse applied to the primary of pulse transformer T3 will result in transistor Q1 being ON while transistor Q2 is pulled OFF. A negative going pulse applied to the primary of pulse transformer T3 will cause transistor Q1 to be turned OFF while transistor Q2 is turned ON. In this fashion, transistors Q1 and Q2 controlled by the direction of the windings on the secondaries of pulse transformer T3 will always ensure that both transistors Q1 and Q2 are not both ON at the same time.

An overvoltage shutdown circuit is used to prevent overvoltage runaway of the present invention in the case of an open load on the ends of power output transformer T1. The overvoltage shutdown circuit of the present invention may be implemented similar to the type described in U.S. Pat. application Ser. No. 07/472,595 filed Jan. 30, 1990 now U.S. Pat. No. 4,980,611, issued on Dec. 25, 1990 entitled "AN OVERVOLTAGE SHUTDOWN CIRCUIT FOR AN EXCITATION SUPPLY FOR GAS DISCHARGE TUBES" and assigned to the same assignee of the present invention, which is hereby incorporated by reference.

In the circuit shown in FIG. 3, an overvoltage sense wire taped adjacent to the core of power transformer T1 will sense the arcing on the secondaries of the transformer by sensing a sharp rise in voltage on the core of power transformer T1. The overvoltage sense will be applied through resistor R6 to the trigger input of SCR Q3. In the preferred embodiment, resistor R6 is approximately 2,000 ohms and resistor R7 is approximately 1,000 ohms. SCR Q3 is, in the preferred embodiment, part number 2N5062 available from Motorola and other semiconductor vendors.

An overvoltage sensed from the core of power transformer T1 will cause the trigger input to turn SCR Q3 ON grounding the threshold and trigger inputs on pins 6 and 2 of 555 timer circuit U1 to ground through-diode effectively shutting down 555 timer U1. Once SCR Q3 is placed in the ON position, the current flowing from the anode to the cathode of SCR Q3 will tend to hold SCR Q3 in the ON state. Even after a removal of the voltage on the overvoltage sense line, SCR Q3 will remain latched in the ON position. While SCR Q3 is latched in the ON position, the trigger and threshold pins 6 and 2 of 555 timer U1 will maintain the circuit in a shutdown configuration. To reset SCR Q3, it becomes necessary to remove power from the AC mains momentarily. In this fashion, the high voltage output of the main power transformer T1 will automatically be shutdown upon sensing an overvoltage condition. In this fashion, runaway overvoltage is prevented such as in the case of powering up the supply 100 with no load attached to terminals $V_1$–$V_2$ of output power transformer T1.

The construction of transformers T1, T2, T3 and T4 shown in FIGS. 3, 4 and 5 are within the skill of those practicing in the art. Transformers T2, T3 and T4 are commonly available transformers or they may be specially constructed according to the specific application of this device. Control transformer T2 is, in the preferred embodiment, a 70 turn primary with two 100 turn secondaries, creating a 1.7:1.0 transfer ratio. The primary and secondaries are wound using 36 gauge wire on a common core and bobbin. As described more fully below, the second secondary of transformer T2 may have a grounded center tap to keep the secondary tied close to ground.

Power transformer T1 is of a more exact construction due to the high voltage multiplication on the secondary. The primary is constructed with approximately 75 turns (or within a range of 60–80 turns) of number 22 gauge insulated stranded wire wound around a high voltage isolation core very similar to those used in the flyback transformers of television sets. The secondaries are wound on a high isolation core comprised of approximately 4,000 turns of number 34 wire. The secondaries are separated into a plurality of segmented windings to reduce the chance of arcing between the windings and allows operation at high frequencies by reducing the capacitance between the windings. For example, the secondary could be segmented into 6 to 8 separate windings separated by suitable insulation to prevent arcing and potted in commonly available insulating plastic to minimize arcing.

In operation, the power supply of FIGS. 3, 4 and 5 is attached to the AC mains through lines $L_1$ and $L_2$. A gas discharge tube containing neon or argon-mercury is attached between the output terminals $V_1$ and $V_2$ of power transformer T1. For initial setup, variable resistor RV1 is turned fully counter-clockwise to cause a high frequency of the switching supply resulting in a low output voltage. The variable resistor RV1 is then turned clockwise until the desired brightness is obtained on the tube 110.

In the preferred embodiment of the present invention, a short may be maintained between outputs $V_1$ and $V_2$ indefinitely without causing damage to the supply. If, however, supply 100 is energized with no load placed between $V_1$–$V_2$, the output voltage will tend to runaway due to an infinite impedance on the secondary of transformer T1. To prevent overvoltage runaway, the overvoltage shutdown circuit of FIG. 3 is used to shutdown the oscillator of 555 timer U1 when an overvoltage condition is sensed. The location of the overvoltage sense wire or foil placed on the core of transformer T1 may be located on the core near any of the high voltage output windings to either sense an arc to the core or an arc directly to the overvoltage sense lead.

Referring to FIG. 4, the first embodiment of the 60 Hz bias circuit will now be described. Connection points U and W connect the dual high voltage secondaries of transformer T1 of FIG. 4 to the connection points for the second secondary of transformer T2 shown in FIG. 3. The primary of transformer T2 is connected to the 110 VAC mains receiving 60 Hz line frequency voltage. The turns ratio of the primary to the second secondary of T2 is selected to produce approximately 1000 volts between connection points U and W. Thus a 8:1 or 10:1 turns ratio would be appropriate. Either the U or W connection points must be grounded as shown in FIG. 4. This will prevent the second secondary of transformer T2 from floating to the high voltage produced on connection points $V_1$ and $V_2$. The second secondary of transformer T2 may alternatively have a center tap tied to ground (as shown on the secondary of transformer T4) to keep the second secondary of transformer T2 close to ground. A grounded center tap may provide a better balance of induced 60 Hz line frequency voltage on the high voltage output.

The purpose of the second secondary of transformer T2 connected between the dual secondaries of transformer T1 is to induce a 60 Hz line frequency bias of approximately 1000 volts onto the output switched high voltage on connection points $V_1$ and $V_2$ which are connected across the gas discharge tube. A 60 Hz line frequency relative to an 18 to 50 kilohertz switching frequency produced from the drive circuit in FIG. 3 acts very much like a slowly switched DC bias. This eliminates or greatly reduces the bubble effect in the gas discharge tube connected across connection points $V_1$ and $V_2$ but without the attendant mercury migration found in argon-mercury gas discharge tubes. Thus a cost effective and reliable method of eliminating mercury migration in a gas discharge power supply is accomplished.

Capacitor C7 connected between connection points U and W of FIG. 4 is designed to provide a load impedance path for high frequency high voltage switched through the dual secondaries of T1 such that the gas discharged tube sees only a single secondary at high frequencies looking into $V_1$ and $V_2$. Capacitor C7 is selected to be 0.01 microfarads which to the second secondary of transformer T2 between connections points U and W, appears to be an open at 60 Hz line frequency.

Those skilled in the art will readily recognize that the transformer used to induce 60 Hz frequency into the high voltage secondary of transformer T1 may be a second secondary of transformer T2 or may be a standalone transformer T4 such as the type shown in FIG. 5. Transformer T4 must also be connected to the 110 VAC mains L1 and L2 and have a turns ratio for producing approximately 1000 volts on its secondary. Thus a turns ratio for T4 would also be approximately 8:1 or 10:1.

Transformer T4 of FIG. 5 is shown with a center tap CT which is grounded. This configuration for the secondary of transformer T4 produces a more balanced voltage on the outputs of $V_1$ and $V_2$. A center tapped second secondary of transformer T2 for inducing the 60 Hz line frequency into the output high voltage on lines $V_1$ and $V_2$ could also be used, or a non-center-tapped secondary on transformer T4 could be used with only one side grounded. To provide a low impedance path between a dual high voltage secondaries of transformer T1, capacitor C8 and C9 are provided between ground.

The introduction of a 60 Hz approximately 1000 volt bias signal into the high frequencies switched excitation voltage on lines 102 and 104 of the output tube effectively breakup the bubble effect normally seen when a harmonic standing wave is induced in the tube. The introduction of this signal is done with passive components having low failure rates and low manufacturing costs. The transformer secondary of T4 or the second secondary of transformer T2 are pegged near ground so that they do not float anywhere near the high voltage on the outputs $V_1$ and $V_2$ thereby eliminating any potential arching between the primaries and secondaries of transformers T2 and T4. The effect of the 60 Hz line frequency signal is to partially modulate the switched AC high voltage resulting in an asymmetric AC high voltage over a short period of time (in the kiloHertz range) but is symmetric over a longer period of time (in the Hertz range). Thus the bubble effect is eliminated in the short time frame and no mercury migration results in the long time frame.

To assist to the present invention to be more efficient in breaking up the bubble effect and smoothing out the bubbles without the attendant mercury migration in the circuit shown in FIG. 3, capacitor C1 is removed, as shown inside the dashed circle. This would allow a 60 Hz ripple to be further modulated onto the high voltage output. This is not an essential part of the present invention but has been found to be cost efficient in reducing component count.

While the present invention has been described in connection with the preferred embodiments thereof, it will be understood that many modifications will be readily apparent to those of ordinary skill in the art and this application is intended to cover any adaptations or variations thereof. Therefore, it is manifestly intended that the invention be limited only by the claims and the equivalents thereof.

What is claimed:

1. An excitation supply for use with a gas discharge tube containing at least mercury, comprising:

oscillator means for producing a switching signal;

means including a power transformer having a low-voltage primary and a high-voltage secondary for switching a low DC voltage into said low-voltage primary of said power transformer to produce a switched AC high voltage on said high-voltage secondary of said power transformer in response to said switching signal;

output means for connecting the AC high voltage on said high-voltage secondary of said power transformer to the gas discharge tube;

and bias means connected to said high-voltage secondary of said power transformer of said output means for placing a lower-voltage line frequency bias voltage onto said high voltage such that the mercury migration to one electrode is retarded by the mixing of the high-voltage and the line frequency bias voltage in the secondary of the transformer; and said bias means further including a line voltage transformer connected to said high-voltage secondary with a center gap of said line voltage transformer grounded to prevent said line voltage transformer from floating at a high voltage.

2. An excitation supply for use with a gas discharge tube containing at least mercury, comprising:

oscillator means for producing a switching signal;

means including a power transformer having a low-voltage primary and a high-voltage secondary for switching a low DC voltage into said low-voltage primary of said power transformer to produce a switched AC high voltage on said high-voltage secondary of said power transformer in response to said switching signal;

output means for connecting the AC high voltage on said high-voltage secondary of said power transformer to the gas discharge tube;

and bias means connected to said high-voltage secondary of said power transformer of said output means for placing a lower-voltage line frequency bias voltage onto said high voltage such that the mercury migration to one electrode is retarded by the mixing of the high-voltage and the line frequency bias voltage in the secondary of the transformer; and said bias means further including a line voltage transformer connected to said high-voltage secondary with at least one side grounded to prevent said line voltage transformer from floating at a high voltage.

* * * * *

UNITED STATES PATENT AND TRADEMARK OFFICE

CERTIFICATE OF CORRECTION

PATENT NO. : 5,231,333

DATED : July 27, 1993

INVENTOR(S) : Edward D. Orenstein

It is certified that error appears in the above-identified patent and that said Letters Patent is hereby corrected as shown below:

In column 2, line 2, "tubes" should read --tube-- therefore.

In column 2, line 22, "use" should read --uses-- therefore.

In column 2, line 32, insert --in-- after the word "results" therefore.

In column 2, line 61, insert --of-- after the word "way" therefore.

In column 5, line 46, "to" should read --in-- therefore.

Signed and Sealed this

Eighth Day of March, 1994

Bruce Lehman

*Attest:*

BRUCE LEHMAN

*Attesting Officer*

*Commissioner of Patents and Trademarks*